US005105395A

United States Patent [19]

Imhof

[11] Patent Number: 5,105,395

[45] Date of Patent: Apr. 14, 1992

[54] METHOD OF AND APPARATUS FOR ASCERTAINING THE TIMES OF PARTICIPANTS IN RACES AND OTHER CONTESTS

[76] Inventor: Augustin Imhof, Winterhalde 8, W-7619, Steinach, Fed. Rep. of Germany

[21] Appl. No.: 614,436

[22] Filed: Nov. 15, 1990

[30] Foreign Application Priority Data

Nov. 15, 1989 [DE] Fed. Rep. of Germany ..... 3937977

[51] Int. Cl.[5] ..... G04F 8/00; G04B 47/00

[52] U.S. Cl. ..... 368/9; 368/10; 368/113; 346/107 B

[58] Field of Search ..... 368/1-3, 368/6, 9, 10, 110-113; 340/323 R, 600; 346/107 A, 107 B

[56] References Cited

U.S. PATENT DOCUMENTS

| | | | |
|---|---|---|---|
| 3,678,189 | 7/1972 | Oswald | 346/107 B |
| 3,714,649 | 1/1973 | Brouwer et al. | 340/408 |
| 3,829,869 | 8/1974 | Balko et al. | 346/107 R |
| 4,643,585 | 2/1987 | Hillesland | 368/9 |

FOREIGN PATENT DOCUMENTS 2535539 8/1977 Fed. Rep. of Germany .

*Primary Examiner*—Vit W. Miska

*Attorney, Agent, or Firm*—Peter K. Kontler

[57] ABSTRACT

The times which elapse while the participants in a race or another contest cover the distance between a starting line and a finish line are ascertained, at an accuracy of one hundredth of a second, with a camera which takes pictures of the finish line at a first frequency and transmits picture signals to a pulse amplifier as well as to a mixing stage which latter transmits picture signals to a video recorder. A timing pulse generator transmits signals at a frequency of one thousandth of a second; such signals are processed in a second generator which transmits processed signals to a pulse separator connected with the output of the amplifier of picture signals. This ensures that each picture receives and exhibits information denoting the exact instant of taking the respective picture irrespective of the frequency of picture taking. The timing pulse generator is started in response to firing of a starter gun, and the picture which is taken at or immediately after the time a contestant crosses the finish line further contains information denoting the exact instant of activation of a photoelectronic detector which monitors the finish line.

14 Claims, 3 Drawing Sheets

METHOD OF AND APPARATUS FOR ASCERTAINING THE TIMES OF PARTICIPANTS IN RACES AND OTHER CONTESTS

BACKGROUND OF THE INVENTION

The invention relates to improvements in methods of and in apparatus for ascertaining the times which elapse while one or more participants (such as humans, animals, motor vehicles, sailboats, bicycles and/or others) in a race or another contest cover a distance between a starting line and a finish line.

It is already known to employ a camera which takes pictures of the finish line at certain intervals in order to furnish evidence of the sequence in which the contestants in a race reach the finish line. It is also known to connect the signal transmitting outlet of the camera with a recording unit which records the pictures so that the outcome of the race can be judged after completion of the actual contest. It was further proposed to employ a timing pulse generator which is started in response to the signal from a photocell, a starter pistol or the like and furnishes signals which denote the time and are imaged onto the pictures of the finish line, and to utilize a photoelectronic detector which generates a signal whenever the winner crosses the finish line or whenever the finish line is crossed by an also ran who or which is not overlapped by the preceding contestant or contestants. In many instances, the camera is designed to take pictures at intervals of two or four hundredths of a second.

The means for recording the pictures can include a video recorder, a video printer and/or a display unit with a screen which displays successively formed pictures of the finish line.

A method and an apparatus of the above outlined character are disclosed, for example, in German Pat. No. 25 35 539 to Masse et al. A drawback of the patented method and apparatus is that the times of taking successive pictures might not always coincide with the times which are recorded on the respective pictures and are supposed to denote the actual times of picture taking. This can be attributable to the fact that the intervals between the taking of successive pictures do not always coincide with the timing of generation of signals which are indicative of time and are imaged on the pictures. Therefore, the patented method and apparatus are designed with a view to ensure that the starting pulse coincide with a synchronizing pulse of the camera; this is intended to ensure that the timing of picture taking will coincide with the timing of the generation of signals which denote time and are imaged on the pictures. In other words, the starting pulse should always coincide with a synchronizing pulse of the camera. The next-following synchronizing pulses of the camera for the taking of individual pictures are thereupon determined by the timing signal of the timing pulse generator.

It follows that the timing pulse generator must perform the additional task of determining the frequency of picture taking by the camera. The user or operator of the camera is in no position to ascertain whether or not this is always the case, i.e., whether or not the timing pulse generator is capable of invariably (even in the event of certain disturbances) accurately regulating the timing of picture taking. In other words, the user or the operator of the patented apparatus is not in a position to know whether or not the timing pulse generator has carried out the necessary adjustments with regard to the starting signal not later than when the contestant or contestants cross the finish line. Consequently, the patented apparatus is intended to but cannot always ensure exact coincidence between the time-representing signals and the times of picture taking.

Another drawback of the patented method and apparatus is that it is necessary to employ a specially designed camera, namely a camera which can be synchronized from the outside. Such specially designed cameras are much more expensive than commercially available series-produced cameras. Moreover, the specially designed camera must be used jointly with a recorder, even for the purposes of training. Still further, if a specially designed camera is damaged or is out of commission for other reasons, it takes much time to obtain an equivalent camera from a maker who specializes in the production and distribution of cameras with externally mounted synchronizing systems.

OBJECTS OF THE INVENTION

An object of the invention is to provide a method of ascertaining times of contestants or participants in a race or another contest with a high degree of accuracy irrespective of the frequency at which a camera takes pictures of the finish line.

Another object of the invention is to provide a method which can be practiced with a commercially available standard camera.

A further object of the invention is to provide a method which renders it possible to ascertain the times of contestants with a degree of accuracy in the range of one hundredth or one thousandth of a second.

An additional object of the invention is to provide a method which renders it possible to accurately ascertain the time of a contestant even if the contestant crosses the finish line at an instant when the camera is not in the process of taking a picture of the finish line.

Still another object of the invention is to provide a method which can be combined with the method disclosed in the commonly owned copending patent application Ser. No. 195,123 filed May 16, 1988.

A further object of the invention is to provide a novel and improved apparatus for the practice of the above outlined method.

An additional object of the invention is to provide the apparatus with novel and improved means for ensuring the recording of proper times on the pictures of the finish line.

Another object of the invention is to provide the apparatus with novel and improved means for ensuring that each picture of the range or region of the finish line contains the exact time of taking the respective picture.

An additional object of the invention is to provide a relatively simple, compact and inexpensive apparatus which can ascertain contestants' times with a degree of accuracy satisfying the highest requirements including those established for olympic games and other contests or groups of contests of similar importance and fame.

Another object of the invention is to provide an apparatus which need not employ an externally synchronized camera.

SUMMARY OF THE INVENTION

One feature of the present invention resides in the provision of a method of ascertaining the time which elapses while a participant or contestant in a race or another contest covers a distance between a starting line and a finish line and wherein the finish line is monitored by a detector which generates a first signal when the finish line is crossed by the contestant, wherein a camera (e.g., a video camera) is set up to take pictures of the range or region of the finish line and to generate picture signals at a first frequency and wherein a timing pulse generator (e.g., a clock) is set in operation in response to a start signal (e.g., from a starter pistol) to generate (at a second frequency) second signals each denoting one of a series of increments of time which elapses from the generation of the start signal. The method comprises the steps of selecting the second frequency to at least match the first frequency so that certain second signals at least substantially coincide with the taking of pictures by the camera, utilizing each at least substantially coinciding second signal to generate a record of the respective increment of time, and imaging the records of coinciding second signals onto the respective pictures.

For example, the first frequency can be two or four hundredths of a second.

The method is preferably designed to ascertain the time of a contestant with a degree of accuracy within a predetermined fraction of a second, as a rule within a hundredth of a second. The second frequency exceeds such predetermined fraction of the second. Thus, if the time of the contestant is to be ascertained within one hundredth of a second, the second frequency is preferably one thousandth of a second.

The method can further comprise the step of imaging the first signal on the picture whose taking coincides with or immediately follows the generation of the first signal so that such picture bears the image of the finish line, of the contestant, the record of the corresponding second signal and the image of the first signal. The difference between the recorded first and second signals is proportional to the extent of advancement of the contestant beyond the finish line. As mentioned above, the first frequency is or can be within one or more hundredths of a second, and the second frequency is or can be within one or more thousandths of a second.

Another feature of the invention resides in the provision of an apparatus for ascertaining the time which elapses while a contestant in a race or another contest covers a distance between a starting line and a finish line. The apparatus comprises a detector which is positioned at the finish line and includes means for generating a first signal when the contestant crosses the finish line, a camera which is set up to take pictures of the finish line and to transmit picture signals at a first frequency, means for recording the pictures, a timing pulse generator (e.g., a clock) which is operable in response to a start signal (e.g., from a starter pistol) to generate second signals at a second frequency which at least matches or is higher than the first frequency whereby each second signal denotes one of a series of increments of time which elapses from the generation of the start signal and the taking of each picture at least substantially coincides with one of the second signals, and means for imaging the coinciding second signals on the respective pictures.

The time which elapses while the contestant covers the distance from the starting line to the finish line is normally ascertained with a degree of accuracy within a predetermined fraction of a second (preferably one-hundredth of a second). The second frequency can exceed such predetermined fraction of a second; for example, the second frequency can equal one thousandth of a second.

The imaging means can include means for imaging the first signal onto the picture which is taken simultaneously with or immediately follows generation of the first signal, and the detector has an output which is connected with the timing pulse generator.

The apparatus can further comprise means for amplifying picture signals which are transmitted by the camera, a pulse separator for amplified picture signals, a signal generator which is connected between the timing pulse generator and the pulse separator, a mixing stage which is connected between the camera and the recording means, and means for connecting the mixing stage with the signal generator.

The recording means can comprise a video recorder, a video printer and/or a display unit having a screen for the pictures.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 2:
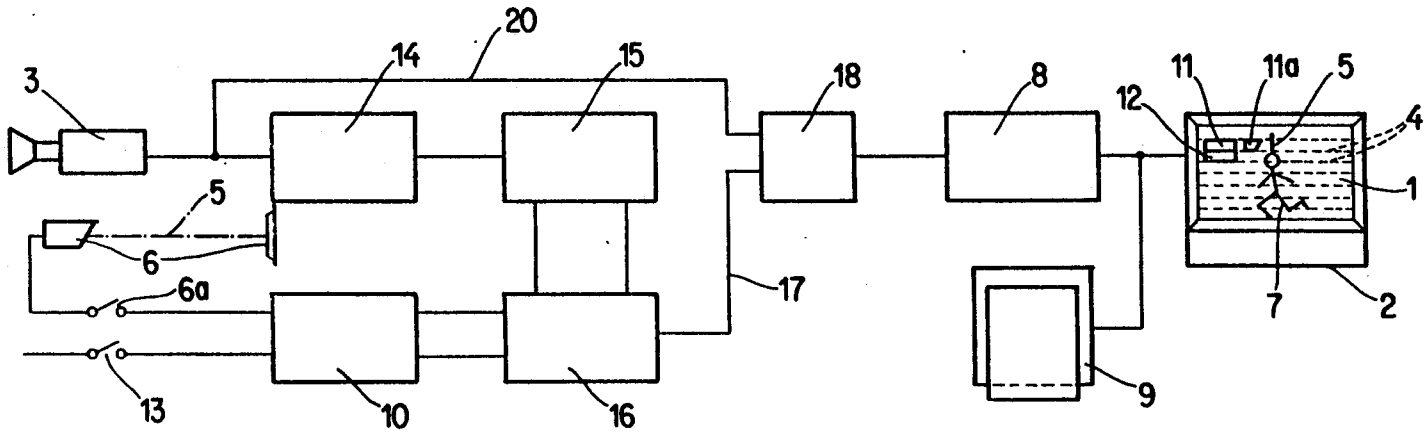
FIG. 2 is a block diagram of the improved apparatus wherein the means for recording successive images of the finish line and other information comprises a video recorder, a video camera and a monitoring unit.

Referring first to FIG. 2, there is shown a recording unit which includes a video recorder 8, a video printer 9 and a display or monitor 2 with a screen 1 showing a picture of the finish line 5. The picture is taken by a video camera 3, and such picture shows the lines 4 between the lanes for contestants or participants. The contestant or participant which is shown crossing the finish line 5 is a human being 7; however, the apparatus can be used with equal or similar advantage to ascertain the times which elapse while a non-human contestant (such as a dog or a horse) or an inanimate contestant (such as a bicycle, a motorcycle, a motor vehicle, a sled or any other conveyance) covers the distance between a starting line (not shown) and the finish line 5. The apparatus further comprises a photoelectronic detector 6 which is positioned at the finish line 5 and serves to generate a first signal when the finish line is crossed by a contestant, such as the winner (7) of the race or an also ran who is not overlapped by the preceding contestant or contestants. Reference may be had to the commonly owned copending patent application Ser. No. 195,123.

The detector 6 can be rendered operative in response to closing of a switch 6a.

The apparatus also comprises a timing pulse generator 10 (hereinafter called clock) which is designed to transmit second signals at a relatively high frequency, preferably at one thousandth of a second. The screen 1 comprises a field or window 11 and a market or index 11a which is adjacent the field 11 and displays a signal denoting the instant of time at which the detector 6 is caused to generate a signal. A further field 12 on the screen 1 of the monitor 2 serves to display increments of time at the frequency which is determined by the clock 10. Thus, the screen 1 can simultaneously display two times, one at the field 11a and the other at the field 12. The clock 10 begins to transmit signals at the preselected high frequency in response to a start signal which is generated on closing of a starter switch 13a, preferably by a starter pistol, by a photoelectronic or other detector or in any other suitable way. Beginning with closing of the switch 13a, the clock 10 transmits second signals at the frequency of one thousandth of a second, and certain of these signals are imaged onto the field 12. The frequency of picture taking by the camera 3 can be and normally is less than the frequency of second signals which are generated by the clock 10 and are displayed in the field 12; for example, the camera can be set up to generate picture signals every two or every four hundredths of a second. The field 12 displays that second signal from the clock 10 which at least substantially coincides with the taking of a picture by the camera 3.

Picture signals which are generated by the camera 3 are amplified by a signal amplifier 14 which transmits amplified signals to the corresponding input of a pulse separator 15. The latter is connected with a signal generator 16 in such a way that the signal generator 16 transmits a (second) signal from the clock 10 whenever such signal at least substantially coincides with a picture taking signal from the camera 3. The purpose of the signal generator 16 is to convert information pertaining to time into video signals (visible information). The output of the signal generator 16 is connected with a mixing stage 18 by way of a conductor 17, and the output of the mixing stage 18 is connected with the video recorder 8. A conductor 20 transmits picture signals from the output of the camera 3 to the mixing stage 18. The inputs of the pulse generator 16 are connected with the corresponding outputs of the clock 10.

Figure 1:
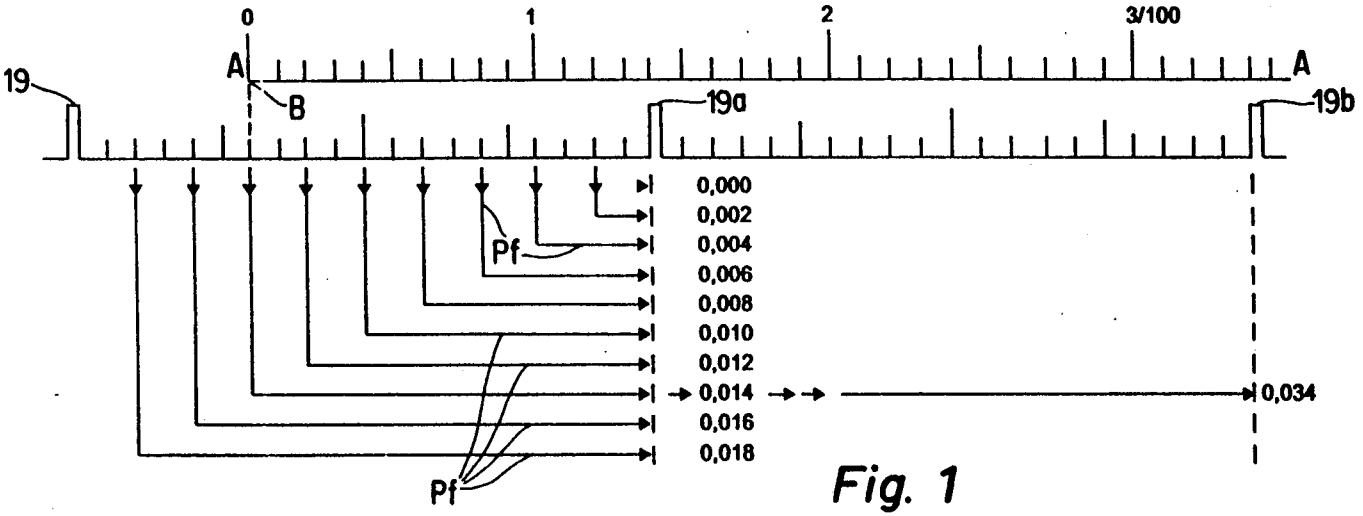
FIG. 1 is a diagram showing the frequency of signal generation by the timing pulse generator, the instant of starting the timing pulse generator in response to closing of a switch, and the frequency of taking pictures by the camera which is trained upon the finish line.

FIG. 1 shows three consecutive picture signals 19, 19a, 19b. The duration of each such signal is approximately one thousandth of a second, and the picture signals are generated at intervals of two hundredths of a second. The indications of contestants' times should be furnished with an accuracy of one hundredth of a second, i.e., the frequency at which the clock 10 transmits second signals is ten times higher than the expected accuracy. FIG. 1 further shows that the clock 10 can transmit a total of twenty second signals between successive picture signals 19, 19a and 19a, 19b. Thus, not only is it possible to record signals at one hundredth of a second between two successively generated picture signals but it is also possible, if the taking of a picture is delayed or shifted relative to the sequence of signals which are transmitted by the clock 10 in response to closing of the starter switch 13a, to record on the picture, with an accuracy in the range of one thousandth of a second, that time difference which exists between the starter signal and the delayed picture taking. Such addressing of the clock 10 takes place in response to the generation of each following picture signal because the frequency of picture signals need not coincide with certain signals from the clock 10 so that it is likely that time shifts will occur within the addressing intervals.

The circuit which is shown in FIG. 2 ensures that the output signals of the camera 3 guarantee the imaging of the then existing second signals from the clock 10. Thus, it is not necessary to synchronize the picture signals 19, 19a, 19b, etc. by the clock 10 and to conform such picture signals to the second signals. The second signal which is furnished by the clock 10 at the time of generation of a picture signal by the camera 3 is displayed in the field 12 on the screen 1 of the monitor 2 because the output of the camera 3 is connected with the mixing stage 18 via conductor 20. The same information (second signal from the clock 10) can be found on each print which is furnished by the video printer 9.

In accordance with a feature of the invention, it is further provided that each picture which is made at the time the winner or certain also ran across the finish line, or each picture following such crossing of the finish line, also contain a second information denoting the time with a degree of accuracy at least matching the desired degree of accuracy of determination of the time of a contestant but preferably with a higher degree of accuracy, e.g., one thousandth of a second if the contestants' times are to be ascertained with a degree of accuracy in the range of one hundredth of a second. The recording of such times is initiated by the first signal (from the detector 6) when or immediately after a contestant 7 crosses the finish line 5, i.e., the first signal also appears in the picture showing the contestant 7 at the time of or immediately subsequent to crossing of the finish line 5. Thus, the picture showing the contestant 7 at the time of or subsequent to crossing of the finish line 5 contains two different recorded times. The difference between the two times which are recorded on such picture is proportional to the distance which the contestant 7 has covered beyond the finish line 5. This renders it possible to ascertain, with a high degree of accuracy, whether or not the detector 6 is properly adjusted and whether or not the picture-time synchronization is satisfactory.

The operation of the improved apparatus is as follows:

The switch 13 can be built into a starter pistol or into a photoelectronic starter. When this switch 13 is closed, the clock 10 is set in operation to transmit second signals at the aforementioned frequency of preferably one thousandth of a second. The second signals are transmitted to the corresponding inputs of the signal generator 16 which processes them into signals suitable for imaging onto the screen 1 of the monitor 2 as well as on the still pictures which are furnished by the video printer 9.

If the detector 6 is activated by a contestant 7 who or which is crossing the finish line 5, the time at which such activation takes place is frozen in the field 11 of the screen 1, for example, until the taking of the next picture by the camera 3 or until the detector 6 is activated again by the next contestant 7 who or which crosses the finish line 5. At such time, the field 11 exhibits the freshly supplied time, i.e., the time of next activation of the detector 6. An inspection of the position of the contestant 7 in the region of the finish line 5 will determine whether or not the time which is supplied by the detector 6 can be considered an official time for the corresponding contestant. If there are any doubts, it is necessary to take into consideration the continuously changing time signals which appear in the field 12. As concerns such continuously changing information in the field 12 of the screen 1, the improved method ensures that such recorded time invariably denotes the position of (distance covered by) the respective contestant 7.

For example, if the camera 3 is set to take pictures at intervals of two hundredths of a second and a contestant happens to be located closer to the finish line on a preceding picture than on the next-following picture (i.e., if the contestant appearing on a first picture is closer to but still in front of the finish line 5 on a preceding picture but is more distant from (though already beyond) the finish line on the next-following picture), the interval between the two picture takings is not less than one hundredth of a second. The controlling time is always that which is recorded as a result of activation of the photoelectronic detector 6 because, if the detector 6 is properly positioned relative to the finish line 5, the time of activation of such detector is indicative of the correct time between the start signal by 13 and the finish signal irrespective of any time-picture synchronization.

The apparatus of the present invention can employ a commercially available camera 3 which need not be provided with external synchronizing means and which is embodies its own pulse generating system. Therefore, the starting pulse from 13 which is used to set in operation the clock 10 can be within the pulse frequency of the camera 3 without causing measurement errors greater than up to one hundredth of a second. This is due to the fact that the frequency of the clock 10 is or can be higher than the frequency of picture signals 19, 19*a*, 19*b* . . . which are transmitted by the camera 3 (a) to the mixing stage 18 via conductor 20 and (b) to the signal amplifier 14. Otherwise stated, the frequency of generation of second signals is or can be higher than the desired accuracy of measurement of times of contestants 7. This renders it possible to ascertain the time which elapses until the taking of a next-following picture. In other words, the expired time coincides with the instant of picture recording and, due to the provision of the aforediscussed addressing system, ensures the recording of proper time on each picture. This is achieved as follows:

The picture signal or video signal which is transmitted by the camera 3 is amplified at 14 and is transmitted to the pulse separator 15. The signal generator 16 stores information furnished by the clock 10 and pertaining to the time which has elapsed from the instant of actuating the starter switch 13, and such information is ready to be recorded on the picture which appears on the screen 1. The information is transmitted via conductor 17 and mixing stage 18 which latter also receives the picture signal 19, 19*a* or 19*b* from the camera 3 via conductor 20. The two sets of information are transmitted by the mixing stage 18 on to the video recorder 8 which records the information on magnetic tape. The information which is stored on magnetic tape in the recorder 8 can be reproduced by the printer 9 and/or displayed on the screen 1 of the monitor 2, for example, when the race is completed so that the progress and the outcome of the race can be evaluated at a later time. The structure which is shown in FIG. 2 is very simple and its components are relatively inexpensive; nevertheless, the apparatus is capable of furnishing times with an accuracy of one hundredth of a second or higher in spite of the absence of means for effecting external synchronization of the camera 3. In addition, the apparatus renders it possible to adjust the detector 6 as well as to adjust the time-picture synchronization.

The camera 3 may but need not be positioned in register with the finish line 5; however, the camera is invariably set up to furnish pictures of the finish line 5 and of the contestant or contestants close to or crossing the finish line.

FIG. 1 shows schematically the progress of time before and between successive picture signals 19, 19*a* and 19*b*. As mentioned above, the camera 3 can be set up to furnish picture signals at a frequency of two or four hundredths of a second. If the frequency is two hundredths of a second, the length of intervals between successive picture signals is twenty thousandths of a second. The scale A of FIG. 1 is indicative of the frequency of second signals which are generated by the clock 10. For example, it is now assumed that the switch 13 is closed at the instant B which coincides with the zero point (0.000 second time) of the scale A. The picture signal 19*a* is generated subsequent to the instant B, namely with a delay of 0.014 second. Such time is recorded on the corresponding picture which is stored in the recorder 8. The next picture signal 19*b* is assumed to be generated two hundredths of a second following generation of the signal 19*a*. Thus, if the picture signal generating frequency of the camera 3 remains unchanged, the time which is recorded on the second picture (signal 19*b*) is 0.034 second.

If the frequency of picture signal generation by the camera 3 deviates from two hundredths of a second, shifts can take place to either side of the time scale. However, such shifts do not affect the accuracy of determination of the times of contestants because the information which is taken over and recorded is that information which is furnished by the clock 10, namely that time which is recorded in the signal generator 16 at the exact instant of taking a picture. Thus, the apparatus invariably ensures that each picture bears information denoting the exact interval of time which has elapsed from the generation of a starting signal by the switch 13 to the instant of taking the respective picture. This holds true even if the frequency at which the camera 3 transmits picture signals to the amplifier 14 and to the mixing stage 18 exceeds or is less than the expected or selected frequency of two hundredths of a second.

Depending on the exact timing of the instant B of closing the starting switch 13, the interval between such closing of the switch 13 and the transmission of picture signal 19*a* can depart from 0.014 second. Different intervals are denoted by the additional arrows Pf which are shown in FIG. 1.

It will be seen that, in contrast to heretofore known proposals, the clock 10 does not serve to initiate and to control the frequency of transmission of picture signals. On the contrary, the improved apparatus is designed to operate in such a way that a picture signal which is transmitted from the amplifier 14 to the pulse separator 15 initiates the transmission of a time signal from the clock 10 through the signal generator 16 to the mixing stage 18 simultaneously with arrival of a picture signal from the camera 3 via conductor 20. Since the frequency of second signals (from clock 10) is preferably higher than the frequency of picture signals, and the intervals between successive second signals are shorter than the desired accuracy (one hundredth of a second) of ascertaining the times of contestants, a signal from the clock 10 is available in the signal generator 16 for transmission to the mixing stage 18 every time the mixing stage receives a picture signal from the camera 3 via conductor 20. Consequently, the times which are recorded on successive pictures are truly indicative of the instants of picture taking with a degree of accuracy in the range of up to one thousandth of a second. Otherwise stated, and since the clock 10 continuously transmits second signals to the signal generator 16, such signals are not "stale" at the time of transmission via conductor 17 but are generated simultaneously with the respective picture signals or the difference is one thousandth of a second, i.e., much less than the desired degree of accuracy of determination of contestants' times.

A modern video camera can take pictures at a frequency of one thousandth of a second. If such camera is used in the improved apparatus, the difference between the instants of taking successive pictures and the instants of generation of second signals which are imaged on the respective pictures is zero or less than one thousandth of a second. Thus, the accuracy of the improved apparatus is not unduly affected if the intervals between the taking of successive pictures are reduced to less than four hundredths or to less than two hundredths of a second.

The accuracy of the improved apparatus is equally unaffected if the taking of a first picture does not coincide with starting of the clock 10 in response to a starting signal on closing of the switch 13. This is shown in FIG. 1 wherein the picture signal 19 is generated prior and the picture signal 19*a* is generated subsequent to the instant (B) of closing of the switch 13 which serves to set the clock 10 in operation. The reason is that the signal generator 16 transmits those processed second signals which coincide or practically coincide with the picture signals so that the possibility of starting the clock 10 between the transmission of two successive picture signals via conductor 20 is of no consequence.

The method and apparatus of the present invention can be combined with or incorporated into the method and apparatus of the commonly owned copending patent application Ser. No. 195,123. Thus, the pictures which are taken with the camera in the apparatus of the copending patent application Ser. No. 195,123 can receive additional information, namely second signals from the clock 10 via signal generator 16.

As mentioned hereinabove, the first signal is recorded at least on one picture which coincides with or immediately follows the advancement of the winner or another contestant across the finish line 5. Thus, the signal which is transmitted by the detector 6 can be "frozen" into a picture which is taken simultaneously with or subsequent to crossing of the finish line 5 by the winning contestant 7 or by any next-following contestant (also ran) who is not overlapped by the preceding contestant. Reference may be had to FIG. 1 of the copending patent application Ser. No. 195,123 wherein the contestants or participants who or which are capable of initiating the generation of a first signal are shown at 15, 20 and 21. Since a picture which is taken immediately subsequent to crossing of the finish line 5 also contains the time which is denoted by the respective second signal, it is quite simple to ascertain the interval of time which has elapsed between actual crossing of the finish line and the taking of the next-following picture. Such interval of time elapses while the contestant who or which has caused the detector 6 to generate a first signal is advancing from the finish line to the position which is shown on the picture taken immediately subsequent to crossing of the finish line.

The judge or judges are in a position to ascertain whether or not the time which is denoted by the recorded second signal is the actual time of the contestant, i.e., because the first signal denotes a time which coincides with the time denoted by the recorded second signal. Thus, it is now possible to ascertain the times of contestants with a very high degree of precision which can exceed one hundredth of a second. Moreover, the judges can accurately ascertain the times of also rans, namely of those contestants who or which did not cause the generation of a first signal. Reference may be had again to FIG. 1 of the copending patent application Ser. No. 195,123 wherein the contestants 18, 19 and 16 did not cause the detector to generate a signal at the time these contestants crossed the finish line. The reason is that these contestants were partially overlapped by the winner or by each other so that only the winner (15) was in a position to initiate the generation of a first signal.

A further important advantage of the improved method and apparatus is that it is now possible to continuously monitor the accuracy of setting of the detector 6 as well as the time-picture synchronization. For example, if a first picture shows a contestant (such as the contestant 7 in FIG. 2) still ahead of the finish line 5 and the next picture shows the same contestant already beyond the finish line, if the distance of such contestant from the finish line in the first picture is less than the distance of the contestant from the finish line in the next-following picture, and if the pictures are being taken at a frequency of two hundredths of a second, the difference between the times which are denoted by the recorded second signals on the first and second pictures is at least one hundredth of a second. The controlling parameter is the time which is denoted by the first signal since, if the detector 6 is properly positioned relative to the finish line 5, the time which is denoted by such first signal is indicative of the contestant's time regardless of the time-picture synchronization. Since the second signals are generated at a frequency which is normally and preferably higher than the frequency of picture signals, e.g., at a frequency of one thousandth of a second if the picture signals are generated at a frequency of two or four hundredths of a second, and if the contestants' times are to be ascertained with an accuracy of one hundredth of a second, the improved method and apparatus ensure that the recorded second signals do not depart from the exact time by one hundredth of a second since the difference between the transmission of a picture signal and the corresponding second signal is not more than one thousandth of a second.

The accuracy of the improved apparatus is still highly satisfactory if the difference between the frequency of second signals and the frequency of picture signals is less than described above with reference to FIGS. 1 and 2. For example, if the second signals are generated (by the clock 10) at a frequency of one hundredth of a second and the picture signals are generated at a frequency of two hundredths of a second, the maximum deviation between the timing of a picture signal generation and the timing of generation of the nearest second signal does not exceed one hundredth of a second. A greater difference between the frequency of second signals and the frequency of picture signals is desirable in certain types of races, such as 100-yard or 200-yard sprints, 60-yard hurdles and certain other contests where the determination of contestants' times with a degree of accuracy of not less than one hundredth of a second is desirable or necessary.

A mixing stage which can be used in the apparatus of the present invention is described and shown on pages 208–209 of "Handbuch der Film- and Videotechnik" by Weber. A signal amplifier and a pulse separator which can be used in the apparatus of FIGS. 2 are described and shown on page 70 of "Fernsehtechnik" by Rudolf Mäusl. A timing pulse generator and a signal generator which can be utilized in the improved apparatus are described and shown on page 509 of "Fernsehtechnik ohne Ballast" (14th Edition) by Limann/Pelka. Certain other details of the improved method and apparatus are shown and described on pages 1 to 4 of applicant's article entitled "Aufzeichnung und Auswertung" (meaning "Recording and Evaluation").

Figure 3:
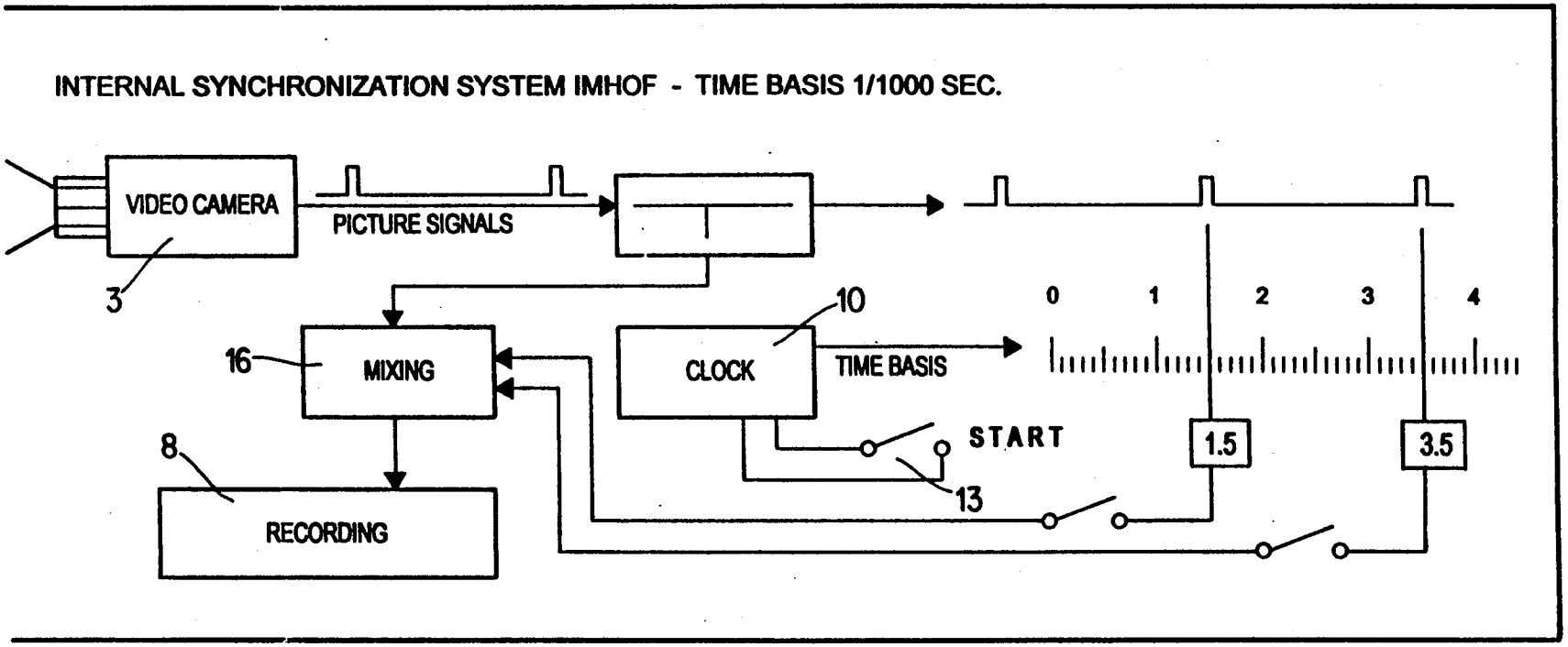
FIG. 3 is another diagrammatic view of the apparatus.

FIG. 3 shows the details of the internal synchronization system of the improved apparatus. This Figure further shows that the taking of the first picture need not coincide with the starting of the clock 10 but that a second signal is generated (by the clock 10) each time a picture is being taken by the camera 3.

Figure 4:
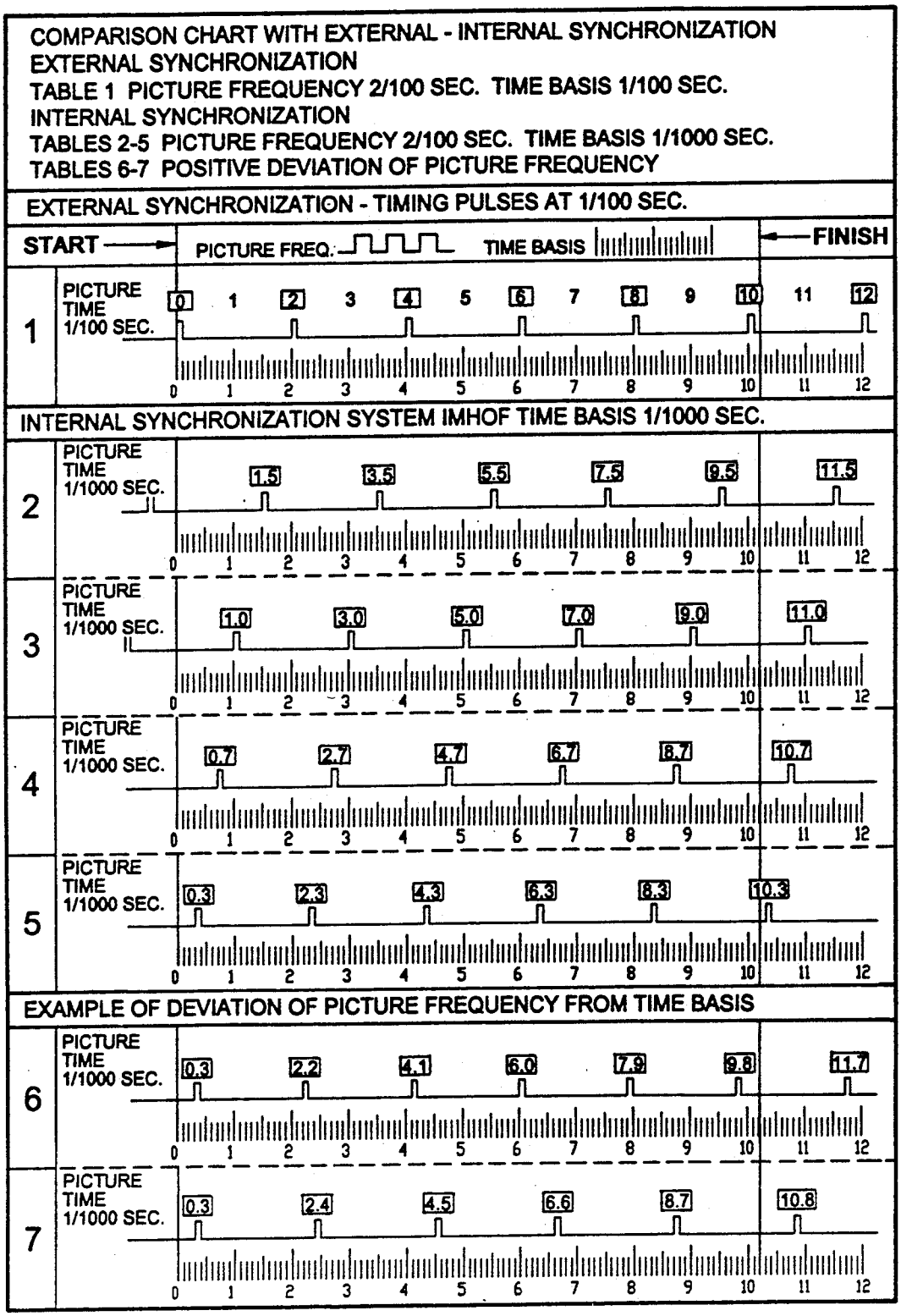
FIG. 4 is a chart with information denoting several different possible relationships between the picture taking frequency and the generation of start signal.

FIG. 4 is a comparison chart. The horizontal row 1 shows external synchronization with timing pulses at 1/100 second. The horizontal rows 2, 3, 4, and 5 show internal synchronization in accordance with the method and in the apparatus of the present invention. The frequency of second signals (transmitted by the clock 10) is 1/1000 second and the frequency of picture taking is 1/200 second. The rows 6 and 7 show two examples of deviation of picture frequency from time basis.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of ascertaining the time which elapses while a contestant in a race or another contest covers a distance between a starting line and a finish line and wherein the finish line is monitored by a detector which generates a first signal when the finish line is crossed by a contestant, wherein a camera is set up to take pictures of the finish line and to transmit picture signals at a first frequency, and wherein a timing pulse generator is set in operation in response to a start signal to generate—at a second frequency—second signals each denoting one of a series of increments of time which elapses from the generation of the start signal, comprising the steps of selecting the second frequency to at least match the first frequency so that certain second signals at least substantially coincide with the taking of pictures by the camera; utilizing each at least substantially coinciding second signal to generate a record of the respective increment of time; and imaging the records of the at least substantially coinciding second signals onto the respective pictures.

2. The method of claim 1, wherein said first frequency is one of two and four hundredths of a second.

3. The method of claim 1 of ascertaining the time which elapses while a contestant in a race or another contest covers a distance between a starting line and a finish line with a degree of accuracy within a predetermined fraction of a second, particularly within a hundredth of a second, wherein said second frequency exceeds said predetermined fraction of a second.

4. The method of claim 3, wherein said second frequency is one thousandth of a second.

5. The method of claim 1, further comprising the steps of imaging the first signal on the picture coinciding with or immediately following the generation of said first signal so that such picture bears the image of the finish line, of the contestant who or which has crossed the finish line, the record of the corresponding second signal and the image of the first signal, the difference between the recorded first and second signals being proportional to the extent of advancement of the contestant beyond the finish line.

6. The method of claim 5, wherein said first frequency is one or more hundredths of a second and said second frequency is approximately one thousandth of a second.

7. Apparatus for ascertaining the time which elapses while a contestant or participant in a race or another contest covers a distance between a starting line and a finish line, comprising a detector positioned at the finish line and including means for generating a first signal when the contestant crosses the finish line; a camera which is set up to take pictures of the finish line and to transmit picture signals at a first frequency; means for recording the pictures; a timing pulse generator operable in response to a start signal to generate second signals at a second frequency at least matching said first frequency, each of said second signals denoting one of a series of increments of time which elapses from the generation of the start signal and the taking of each picture at least substantially coinciding with one of said second signals; and means for imaging said at least substantially coinciding second signals on the respective pictures.

8. The apparatus of claim 7 for ascertaining the time which elapses while a contestant in a race or another contest covers a distance between a starting line and a finish line with a degree of accuracy within a fraction of a second, wherein said second frequency exceeds said predetermined fraction of a second.

9. The apparatus of claim 8, wherein said degree of accuracy is within one hundredth of a second and said second frequency is one thousandth of a second.

10. The apparatus of claim 7, wherein said imaging means includes means for imaging said first signal on the picture coinciding with or immediately following the generation of said first signal, said detector having an output connected with said generator.

11. The apparatus of claim 7, further comprising means for amplifying said picture signals, a pulse separator for amplified signals, a signal generator connected between said timing pulse generator and said pulse separator, a mixing stage connected between said camera and said recording means, and means for connecting said mixing stage with said signal generator.

12. The apparatus of claim 7, wherein said recording means includes a video recorder.

13. The apparatus of claim 7, wherein said recording means comprises a video printer.

14. The apparatus of claim 7, wherein said recording means includes a display unit having a screen for said pictures.

* * * * *